US008350197B2

(12) United States Patent
Tominaga et al.

(10) Patent No.: US 8,350,197 B2
(45) Date of Patent: Jan. 8, 2013

(54) INDUCTION HEATING COOKER

(75) Inventors: Hiroshi Tominaga, Hyogo (JP); Kenji Watanabe, Nara (JP); Masaharu Ohashi, Hyogo (JP); Shintaro Noguchi, Hyogo (JP); Tomoya Fujinami, Hyogo (JP)

(73) Assignee: Panasonic Corporation, Osaka (JP)

( * ) Notice: Subject to any disclaimer, the term of this patent is extended or adjusted under 35 U.S.C. 154(b) by 985 days.

(21) Appl. No.: 12/279,109

(22) PCT Filed: Feb. 20, 2007

(86) PCT No.: PCT/JP2007/053016
§ 371 (c)(1),
(2), (4) Date: Aug. 12, 2008

(87) PCT Pub. No.: WO2007/097295
PCT Pub. Date: Aug. 30, 2007

(65) Prior Publication Data

US 2009/0001072 A1 Jan. 1, 2009

(30) Foreign Application Priority Data

Feb. 21, 2006 (JP) ..... 2006-043372

(51) Int. Cl.
*H05B 6/12* (2006.01)

(52) U.S. Cl. ..... 219/625; 219/627; 219/626

(58) Field of Classification Search ..... 219/620–627; 99/325, 451
See application file for complete search history.

(56) References Cited

FOREIGN PATENT DOCUMENTS

| | | | |
|---|---|---|---|
| JP | 2002-75624 A | | 3/2002 |
| JP | 2003109736 A | * | 4/2003 |
| JP | 2004-111055 A | | 4/2004 |
| JP | 2004-273303 A | | 9/2004 |
| JP | 2005-38660 A | | 2/2005 |
| JP | 2005-78902 A | | 3/2005 |
| JP | 2005-122962 A | | 5/2005 |
| JP | 2005-149829 A | | 6/2005 |

OTHER PUBLICATIONS

International Search Report for PCT/JP2007/053016, dated May 22, 2007.

* cited by examiner

*Primary Examiner* — Henry Yuen
*Assistant Examiner* — Jianying Atkisson
(74) *Attorney, Agent, or Firm* — RatnerPrestia

(57) ABSTRACT

An induction heating cooker including a top plate where a pan is placed; a heating coil for induction heating the pan; an inverter circuit for supplying a high frequency current to the heating coil; an infrared sensor, which is arranged under the heating coil and detects an infrared light radiated from the pan; a light guiding part including an upper opening formed at an upper end facing the top plate and a lower opening formed at a lower end, and guiding the infrared light from the pan to the infrared sensor; and a control unit for controlling an output of the inverter circuit according to an output from the infrared sensor; wherein the light guiding part includes a nonmetallic material part in which the upper opening is formed upper than a lower surface of the heating coil.

11 Claims, 3 Drawing Sheets

INDUCTION HEATING COOKER

This application is a U.S. National Phase Application of PCT International Application PCT/JP2007/053016.

TECHNICAL FIELD

The present invention relates to an induction heating cooker using an infrared sensor.

BACKGROUND ART

First, a conventional induction heating cooker will be described. FIG. 3 is a view showing a configuration of conventional induction heating cooker 100.

As shown in FIG. 3, induction heating cooker 100 includes top plate 32 for holding pan 31, and heating coil 33 for heating pan 31 on a lower side of top plate 32.

Infrared sensor 35 is arranged at a central portion of heating coil 33, temperature calculating unit 37 calculates the temperature of a bottom of the pan according to an output from infrared sensor 35, and control unit 38 controls an output of inverter circuit 34 connected to heating coil 33 based on the temperature calculated in temperature calculating unit 37.

Waveguide 36 made of non-magnetic metal material such as aluminum for guiding infrared light radiated from pan 31 to infrared sensor 35 is arranged on an upper side of infrared sensor 35.

Furthermore, to reduce self-heating of waveguide 36 by the magnetic flux from heating coil 33, first magnetism prevention unit 39 of plate shape made from a material having high permeability such as ferrite is arranged below heating coil 33, and second magnetism prevention unit 40 of plate shape having high permeability such as ferrite is arranged on an inner side of heating coil 33 at the periphery of waveguide 36.

According to such configuration, infrared sensor 35 is prevented from being influenced by infrared light radiated from other than the bottom of pan 31, that is, waveguide 36 heated by the magnetic field generated by heating coil 33 in induction heating cooker 100 (see e.g., patent document 1).

However, in the conventional configuration described above, if pan 31 is heated in an empty pan state, the temperature might rapidly rise at the central portion (region B in FIG. 3) in the width direction of heating coil 33 where the magnetic flux density is the highest. In such case, even if the temperature of the bottom of the pan is detected with infrared sensor 35 arranged at the central portion (region A in FIG. 3) of pan 31 and controlled to lower than an ignition temperature of oil, the temperature of the bottom of the pan at the central portion in the width direction of heating coil 33 has a possibility of reaching a level of ignition temperature of the oil.

If the heating output is controlled with such method of detecting the bottom of the pan, in particular, if a thin stainless pan with poor heat conduction and low heat capacity is used, the bottom of the pan may be heated to red heat and the pan may be deformed if heated in an empty pan state.

The temperature of the portion of pan 31 that becomes a temperature higher than the upper part of the center of heating coil 33 can be detected by arranging infrared sensor 35 at the central portion in the width direction of heating coil 33 or arranging the same close to an inner periphery of a winding part at a central opening of heating coil 33. However, if infrared sensor 35, waveguide 36, and second magnetism prevention unit 40 are arranged at an intermediate portion of the winding parts of heating coil 33, the occupying space of such component becomes large. Therefore, it becomes difficult to mount close to the portion that becomes a higher temperature of pan 31 while reducing the influence on the shape of heating coil 33. If second magnetism prevention unit 40 is omitted to reduce the occupying space of the components such as infrared sensor 35, waveguide 36 may generate heat, and the temperature detection precision by infrared sensor 35 may lower from the influence of infrared light radiation of waveguide 36, as described above.

[Patent document 1] Unexamined Japanese Patent Publication No. 2005-38660

DISCLOSURE OF THE INVENTION

In view of the above problems, the present invention provides a safe induction heating cooker having a low possibility of oil ignition even in cooking with small amount of oil or having a low possibility of the bottom of the pan heating to red heated/deformed even if the pan is heated in an empty pan state irrespective of the thickness and the material of the pan.

An induction heating cooker of the present invention includes a top plate where a pan is placed; a heating coil for induction heating the pan; a heating coil supporting board for holding the heating coil; an inverter circuit for supplying a high frequency current to the heating coil; an infrared sensor, which is arranged under the heating coil and detects an infrared light radiated from the pan; a light guiding part including an upper opening formed at an upper end facing the top plate and a lower opening formed at a lower end, and guiding the infrared light from the pan to the infrared sensor through the upper opening and the lower opening; and a control unit for controlling an output of the inverter circuit according to an output from the infrared sensor; wherein the light guiding part includes a nonmetallic material part in which the upper opening is formed upper than a lower surface of the heating coil.

According to such configuration, when heated in an empty pan state, the temperature of the peripheral portion of the pan where the temperature rise is drastic can be accurately measured by the infrared sensor, and the output of the inverter circuit can be controlled based on such measurement result, and thus a safe induction heating cooker having a low possibility of oil ignition even when cooking with small amount of oil or having a low possibility of the bottom of the pan heating to red heat and deforming even when empty pan heated irrespective of the thickness and the material of the pan.

Furthermore, a ferrite may be arranged under the heating coil to concentrate a magnetic flux under the heating coil on a vicinity of the heating coil; wherein the light guiding part has the lower opening positioned lower than a lower surface of the ferrite.

According to such configuration, the magnetic flux concentrated at the nonmetallic material part interlinks, and thus self heating of the light guiding part due to influence of magnetic flux from the heating coil is further suppressed.

Moreover, a convex lens may be arranged at the upper side of the infrared sensor to collect light so as to increase an amount of infrared light entering the infrared sensor from the pan without being reflected in the light guiding part.

According to such configuration, the components directly radiated from the pan can be dominantly entered to the infrared sensor more than the reflected components in the light guiding part, and thus the temperature of the bottom of the pan can be more accurately measured.

A wall surface of a passage from the pan to the infrared sensor of the light guiding part may be formed by a light absorbing material.

If the wall surface of the passage from the pan to the infrared sensor of the light guiding part is formed with light absorbing material such as resin that less likely reflects light such as black, brown, or gray, the components reaching after being reflected in the light guiding part reduces of the infrared light entering the infrared sensor and the percentage of the components directly radiated from the pan can be increased, whereby the temperature of the bottom of the pan can be more accurately measured.

Furthermore, a shield part for shielding unnecessary radiation or light from the heating coil to the infrared sensor may be arranged at a periphery of the infrared sensor; wherein the light guiding part includes a non-magnetic metal material part connecting to the lower opening at the lower side of the nonmetallic material part, the shield part and the non-magnetic metal material part of the light guiding part being integrally formed.

According to such configuration, unnecessary radiation or light from the heating coil to the infrared sensor is shielded and the non-magnetic metal material of the light guiding part can be easily configured. The gap between the shield part and the light guiding part is easily eliminated, so that influence of electromagnetic field and ambient light from the periphery on the infrared sensor is suppressed.

A heating coil supporting board for supporting the heating coil and the ferrite may be arranged; wherein the nonmetallic material part of the light guiding part is arranged on the heating coil supporting board.

According to such configuration, the nonmetallic material part of the light guiding part can be easily configured. The position relationship can be stabilized without the light guiding part being attached tilted with respect to the heating coil, and thus temperature detection precision by the infrared sensor can be enhanced.

The nonmetallic material part of the light guiding part may be integrally molded with the heating coil supporting board with a same resin.

According to such configuration, the nonmetallic material part of the light guiding part can be easily formed.

A shield part for shielding unnecessary radiation or light from the heating coil to the infrared sensor at a periphery of the infrared sensor may be arranged; wherein a lower end of the light guiding part is inserted into an interior of the shield part from a shield part opening formed in the shield part.

According to such configuration, the shield part has a simple configuration.

An upper end of the light guiding part may be positioned upper than an upper surface of the heating coil.

According to such configuration, the influence of the infrared light radiation from the peripheral components such as heating coil on the infrared sensor is further suppressed, and the temperature detection precision by the infrared sensor can be enhanced. The hot air flowing over the upper surface of the heating coil flows in from the upper opening of the light guiding part and blows on the infrared sensor thereby suppressing the temperature of the infrared sensor from rising.

The light guiding part may be arranged between an inner periphery of the heating coil and an outer periphery of the heating coil.

According to such configuration, influence by solar light and ambient light of incandescent light bulb on the infrared sensor can be suppressed even when heating a relatively small pan.

The light guiding part may be arranged at a vicinity of an inner side of an inner periphery of the heating coil.

According to such configuration, the heating coil does not need to be divided and the temperature of the portion having the highest pan temperature on the inner side of the inner periphery of the heating coil can be measured, and influence by solar light and ambient light of incandescent light bulb on the infrared sensor can be suppressed even when heating a relatively small pan.

As described above, according to the present invention, a safe induction heating cooker having a low possibility of the bottom of the pan heating to red heated/deformed even if the pan is heated in an empty pan state irrespective of the thickness and the material of the pan is provided.

REFERENCE MARKS IN THE DRAWINGS

Figure 1:
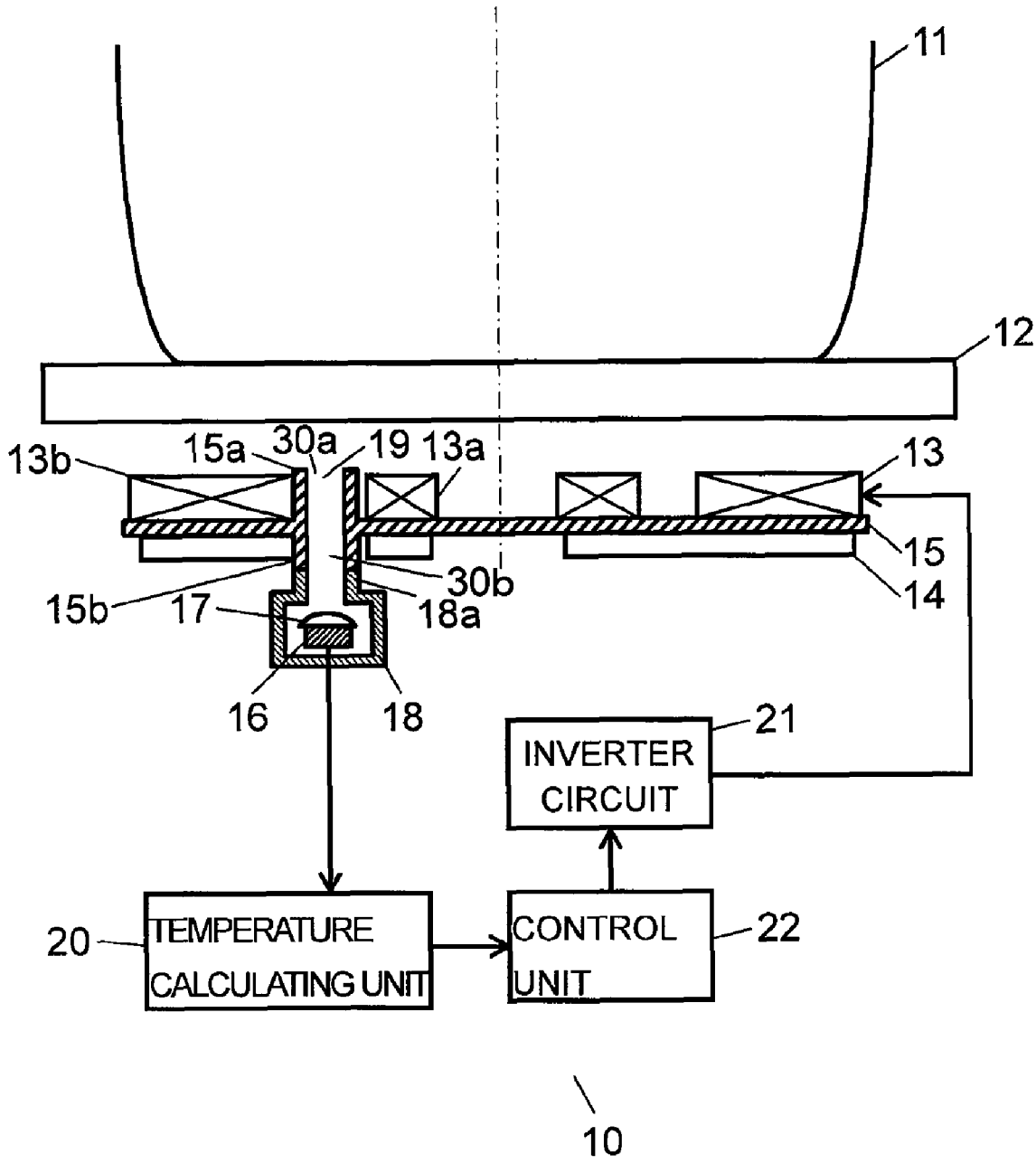
FIG. 1 is a view showing a configuration of an induction heating cooker according to an embodiment of the present invention.

10, 100 induction heating cooker
11, 31 pan
12, 32 top plate
13, 33 heating coil
13*a* inner coil
13*b* outer coil
13*c* inter-coil
14 ferrite
15 heating coil supporting board
15*a*, 15*b*, 18*a* projection
16, 35 infrared sensor
17 convex lens
18 shield part
19 light guiding part
20, 37 temperature calculating unit
21, 34 inverter circuit
22, 38 control unit
30*a* upper opening
30*b* lower opening
36 waveguide
39 first magnetism prevention unit
40 second magnetism prevention unit

PREFERRED EMBODIMENTS FOR CARRYING OUT OF THE INVENTION

Embodiment of the present invention will be described with reference to the drawings. It should be noted that the present invention is not limited to such embodiment.

(Embodiment)

Figure 2:
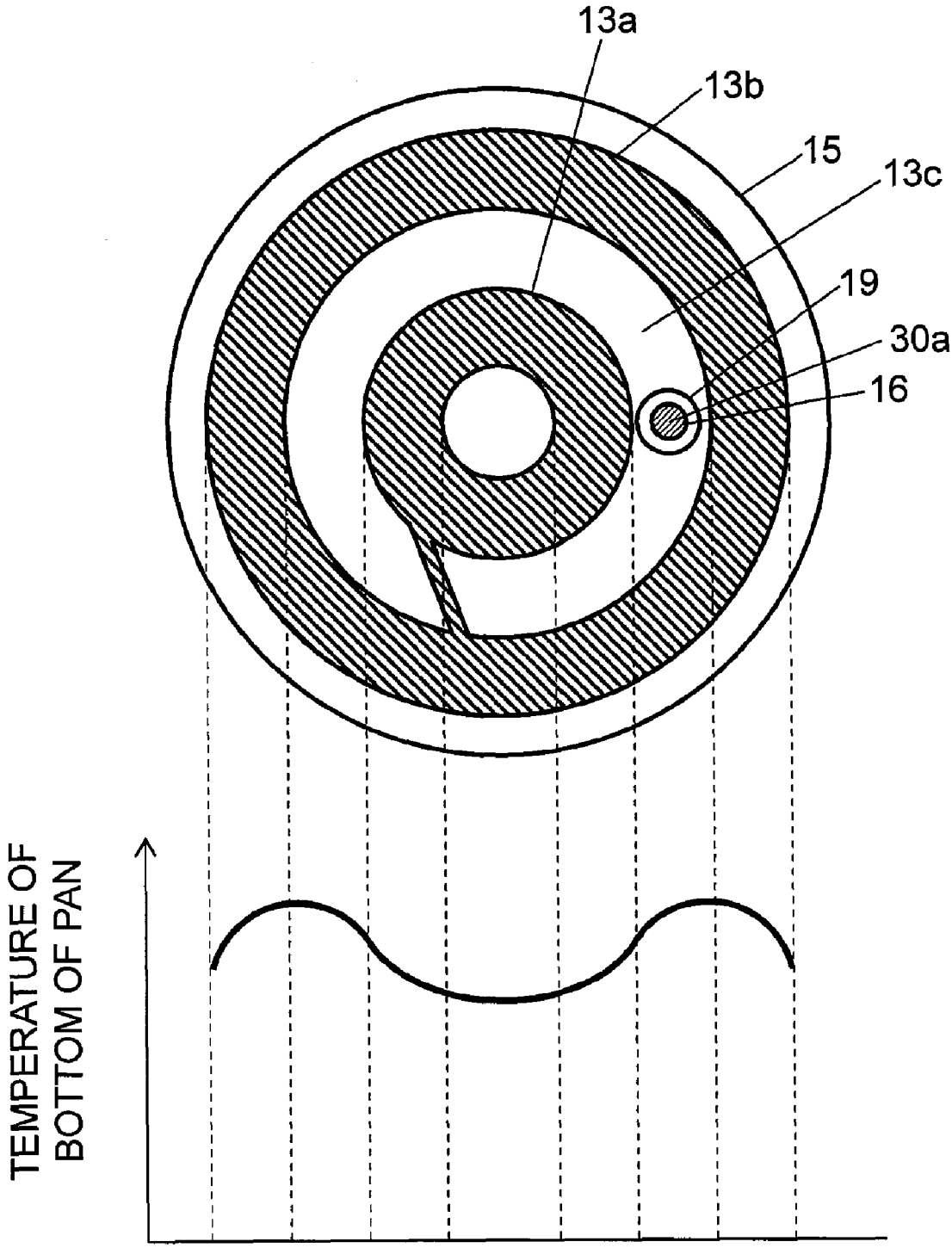
FIG. 2 is a plan view showing a configuration of the vicinity of a heating coil of the induction heating cooker according to the embodiment of the present invention, and a view showing one example of a temperature distribution of the bottom of the pan.
Figure 3:
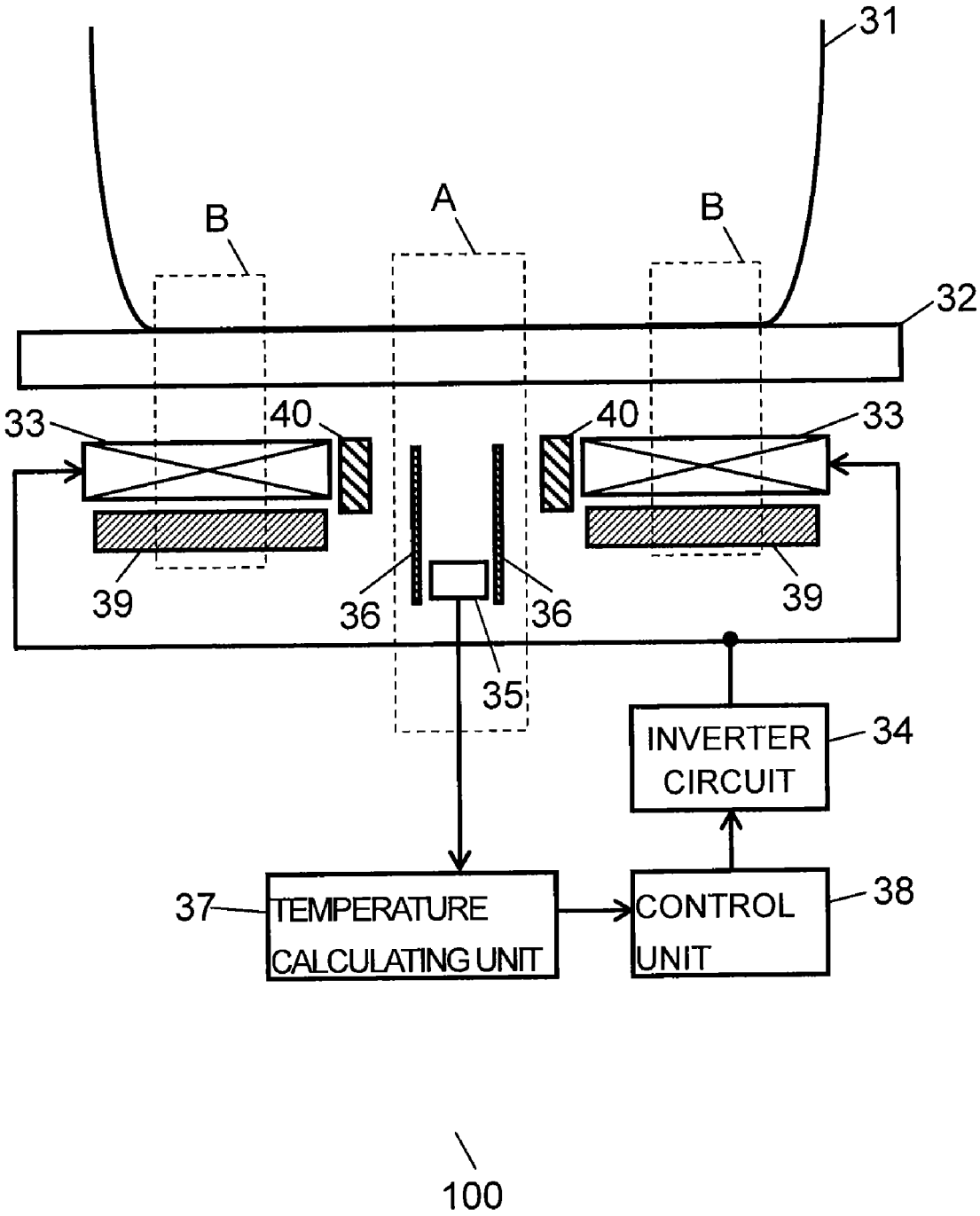
FIG. 3 PRIOR ART
FIG. 3 is a view showing a configuration of a conventional induction heating cooker.

FIG. 1 is a view showing a configuration of induction heating cooker 10 according to an embodiment of the present invention. FIG. 2 is a plan view showing a configuration of the vicinity of heating coil 13 of induction heating cooker 10 according to the embodiment of the present invention, and a view showing one example of a temperature distribution of the bottom of the pan.

As shown in FIG. 1, induction heating cooker 10 includes top plate 12 for mounting load pan 11 (hereinafter also simply referred to as pan), and heating coil 13, arranged at a lower part of top plate 12, for heating pan 11. Heating coil 13 has a divided-winding configuration of inner coil 13*a* and outer coil 13*b*.

Heating coil 13 is supported by heating coil supporting board 15 configured by a black heat-resistant resin material having low transmissivity to infrared light. Heating coil supporting board 15 includes light guiding part 19 having circular upper opening 30*a* formed at an upper end between inner coil 13*a* and outer coil 13*b*. Heating coil supporting board 15 includes projections 15*a* and 15*b* or nonmetallic material parts made of nonmetallic material having a path of circular cross-section formed on the inner side in an up and down direction in FIG. 1 at the periphery of light guiding part 19.

Ferrite 14 for concentrating the magnetic flux from heating coil 13 to pan 11 at the vicinity of heating coil 13 is arranged on a side (lower side in FIG. 1) opposite to the side mounted with heating coil 13 of heating supporting board 15.

Infrared sensor 16 for detecting the infrared light from the bottom of pan 11 is arranged lower than ferrite 14 between inner coil 13*a* and outer coil 13*b*. Infrared sensor 16 is arranged with convex lens 17 for collecting the infrared light entered from pan 11 to infrared sensor 16 without being reflected at the inner side of light guiding part 19.

At the periphery of infrared sensor 16, shield part 18 configured by a non-magnetic metal material having high conductivity such as aluminum for shielding or cutting unnecessary radiation or light to infrared sensor 16 is arranged. Projection 18*a* or a non-magnetic metal material part made of non-magnetic metal material having a path of circular cross-section formed on the inner side is arranged integrated with the upper part of shield part 18, for example, integrally molded with the upper surface of shield part 18 as in aluminum die casting. The upper end of projection 18*a* is contacted to and connected to the lower end of above-described projection 15*b*.

In induction heating cooker 10, upper opening 30*a* opened to face top plate 12 is formed at the upper end of projection 16*a* of heating coil supporting board 15, and is formed to be higher than the upper surface of the windings of heating coil 13. Lower opening 30*b* opened in the direction of infrared sensor 16 is formed at the lower end of projection 15*b* of heating coil supporting board 15, where the lower end of projection 15*b* of heating coil supporting board 15 and upper end of projection 18*a* of shield part 18 are connected at the lower side than the lower surface of ferrite 14. The connection of the upper end of projection 18*a* and projection 15*b* is carried out by fitting, and the like.

One part (portion between projections 15*a* and 15*b*) of heating coil supporting board 15, and projections 15*a*, 15*b* form the nonmetallic material part of light guiding part 19 with resin having low light reflectivity of black, brown, or gray, which is a light absorbing member, where such nonmetallic material part and projection 18*a* of shield part 18, which is the non-magnetic metal part, together serve as light guiding part 19 for guiding the infrared light from pan 11 to infrared sensor 16.

In induction heating cooker 10, the output from infrared sensor 16 is transmitted to temperature calculating unit 20. Temperature calculating unit 20 calculates the temperature of the bottom of pan 11 from the output from infrared sensor 16.

A signal indicating the temperature calculated in temperature calculating unit 20 is transmitted to control unit 22. Control unit 22 controls the output of inverter circuit 21 in response to the signal from temperature calculating unit 20. Temperature calculating unit 20 may be omitted, and control unit 22 may directly control the output of inverter circuit 21 in response to the output of infrared sensor 16 including temperature information.

Inverter circuit 21 supplies a high frequency current to heating coil 13 according to the control of control unit 22.

FIG. 2 shows one example of temperature distribution of the bottom of pan 11 when heated with heating coil 13, in correspondence to the plan view of the vicinity of heating coil 13 in the embodiment of the present invention. The temperature distribution shown in FIG. 2 is obtained when pan 11 is heated using heating coil 13 having a divided-winding configuration of inner coil 13*a* and outer coil 13*b*.

The operation of induction heating cooker 10 configured as above will be described.

When heating is started, inverter circuit 21 supplies high frequency current to heating coil 13 according to the control of control unit 22. Heating coil 13 thereby generates magnetic flux, and pan 11 self heats by the magnetic flux from heating coil 13.

The temperature of the bottom of pan 11 immediately after the start of heating is such that the temperature is the highest at the vicinity of the inner diameter of outer coil 13*b* of heating coil 13 and the temperature is the lowest near the center of heating coil 13, as shown in FIG. 2, due to the influence of magnetic flux density distribution generated from heating coil 13.

In induction heating cooker 10, infrared sensor 16 is arranged between inner coil 13*a* and outer coil 13*b* of heating coil 13 (this space is hereinafter referred to as inter-coils 13*c*) to detect the temperature of the portion of pan 11 where the temperature becomes the highest in view of empty pan heating etc. Thus, the temperature of the portion where the temperature rises most during heating can be measured in induction heating cooker 10.

Temperature calculating unit 20 converts to temperature using the output from infrared sensor 16, and transmits the same to control unit 22. Control unit 22 lowers the output of inverter circuit 21 if the temperature calculated in temperature calculating unit 20 exceeds a predetermined temperature.

Thus, through the use of induction heating cooker 10, pan 11 is prevented from being heated over the predetermined temperature and safe and secure configuration can be realized.

As shown in FIG. 1, infrared sensor 16 is arranged lower than ferrite 14 forming a magnetic path of the magnetic flux from heating coil 13 to the lower side so as to be less susceptible to the magnetic flux from heating coil 13 in induction heating cooker 10.

Furthermore, as described above, infrared sensor 16 is covered by shield part 18 made from a non-magnetic metal material such as aluminum to reduce the influence of the magnetic field from heating coil 13 and the influence of ambient light in induction heating cooker 10. Shield part 18 is also arranged lower than the lower surface of ferrite 14 to reduce influence of the magnetic flux from heating coil 13 and thermal influence.

In induction heating cooker 10 according to the present embodiment, convex lens 17 is arranged on the path through which the infrared light radiated from pan 11 is guided to infrared sensor 16, and the infrared light radiated from pan 11, entered from upper opening 30*a* of light guiding part 19 and reaching the vicinity of the infrared sensor without being reflected by the inner wall of light guiding part 19 can be collected.

According to such configuration, since the components directly radiated from pan 11 can be dominantly entered to infrared sensor 16 more than the reflected components in light guiding part 19, the percentage of the incident amount of the infrared light radiated from the location desired to be measured of pan 11 with respect to the incident amount of the infrared light radiated from the location other than the location desired to be measured of pan 11 can be increased, and an accurate measurement of the temperature of the bottom of pan 11 facing upper opening 30*a* of light guiding part 19 can be made.

Furthermore, by forming projection 15*a* and projection 15*b* with black resin material, and having the wall surfaces of the passage from pan 11 to infrared sensor 16 of light guiding part 19 black, brown, gray, or the like using light absorbing material, the reflected components in light guiding part 19 are further reduced, the percentage of the components directly radiated from pan 11 in the infrared light amount entering infrared sensor 16 can be further increased, and an accurate measurement of the temperature of the bottom surface of pan 11 can be made.

Furthermore, light guiding part 19 of induction heating cooker 10 has the upper part thereof configured by one part of heating coil 13, as well as projection 15*a* and projection 15*b* of heating coil supporting board 15, and has the lower part thereof configured by projection 18*a* of shield part 18. Thus, the noise resistance property or an immunity to electromagnetic field noise of infrared sensor 16 can be enhanced, and entering of light other than from light guiding part 19 can be reduced by forming the portion (projection 18*a*) closer to infrared sensor 16 of light guiding part 19 with metal material.

Since light guiding part 19 includes projection 15*a* or a nonmetallic material part in which upper opening 30*a* is formed upper than the lower surface of heating coil 13, projection 15*a* is not induction heated by the magnetic flux of heating coil 13 and thus is not self-heated, whereby the infrared light having low correlation with temperature rise of pan 11 is suppressed from entering infrared sensor 16.

Furthermore, since projection 15*b* of heating coil supporting board 15 made from a heat resistance resin, which is a non-magnetic material, and projection 18*a* of the shield part are joined at the lower side than the lower surface of ferrite 14, as described above, the magnetic flux emitted downward from heating coil 13 and concentrated at ferrite 14 interlinks with a non-magnetic metal component so that the relevant non-magnetic metal component is suppressed from self-heating. Therefore, light guiding part 19 is self-heated, and entering of the infrared light having low correlation with the temperature rise of pan 11 to infrared sensor 16 is reduced.

Furthermore, since light guiding part 19 is passed through heating coil 13 in the up and down direction, and is continuously arranged from an opening near a light receiving surface of infrared sensor 16 to upper opening 30*a* formed above the upper surface of heating coil 13, infrared sensor 16 is less susceptible to the infrared radiation of each peripheral component such as heating coil 13 and wind from a cooling fan (not shown) that became warm by the heat of heating coil 13 and the wind is less likely to enter light guiding part 19.

Generally, most heating coils 13 have a diameter of about ϕ 180, in which case the bottom diameter of pan 11 that can be heated is in most cases greater than or equal to ϕ 120.

In induction heating cooker 10, infrared sensor 16 arranged in inter-coil 13*c* between inner coil 13*a* and outer coil 13*b* is desirably arranged at a position (e.g., smaller than or equal to radius 45 mm) of smaller than or equal to 50% of the radius (outer diameter of outer coil 13*b*) of heating coil 13 from the center of heating coil 13. According to such configuration, solar light or light of incandescent light bulb entering from the periphery of pan 11 can be reduced and the influence on infrared sensor 16 can be suppressed even when heating pan 11 of small bottom diameter (e.g., pan having bottom diameter of ϕ 120 and radius of about 60 mm).

In the present embodiment, infrared sensor 16 is shielded by shield part 18, but similar effects can be obtained by forming a circuit etc. for amplifying the signal of infrared sensor 16 on the same print wiring board as infrared sensor 16, and shielding the entire board by shield part 18.

Infrared sensor 16 may be configured with chip components, and convex lens 17 may be mounted on the print wiring board mounted with infrared sensor 16.

Moreover, the projecting plane of light guiding part 19 is configured to be a circle in the present embodiment, but similar effects can be obtained with other shapes such as square and ellipse.

In the present embodiment, light guiding part 19 including projections 15*a*, 15*b* of heating coil supporting board 15 of light guiding part 19, and projection 18*a* of shield part 18 is configured to have the same radius, but the present invention is not limited to such configuration. For instance, the radius of projections 15*a*, 15*b* of heating coil supporting board 15 may be larger than the radius of projection 18*a* of shield part 18, so that projection 18*a* of shield part is inserted within the radius of projection 15*b* of heating coil supporting board 15. In this case as well, similar effects can be obtained by arranging the upper end of projection 18*a* of shield part 18 so as to be lower than the lower surface of ferrite 14.

As described above, in induction heating cooker 10 of the present embodiment, convex lens 17 is arranged at the vicinity of the light receiving surface of infrared sensor 16, and light guiding part 19 is configured using the resin material (projections 16*a*, 15*b* of heating coil supporting board) and the non-magnetic metal material (projection 18*a* of shield part 18). Thus, light guiding part 19, which is the detecting portion of infrared sensor 16, can be miniaturized and arranged in the inter-coil between inner coil 13*a* and outer coil 13*b* of heating coil 13, so that the temperature of the vicinity of the portion at where the temperature of the bottom of pan 11 is likely to rise the most can be detected during empty pan heating, whereby heating to red heat and deformation of the pan by empty pan heating, as well as ignition and smoke emission when heating of small amount of oil can be suppressed.

According to the present embodiment, shield part 18 and light guiding part 19 may be integrated to easily configure the non-magnetic metal material portion of light guiding part 19.

Furthermore, since heating coil supporting board 15 and light guiding part 19 are integrated, the nonmetallic material portion of light guiding part 19 can be easily configured.

Since the upper end of light guiding part 19 is arranged so as to be higher than the upper surface of heating coil 13, influence by the infrared radiation from the peripheral components (e.g., heating coil 13) on infrared sensor 16 can be reduced, or the cold wind heated by heating coil 13 or pan 11 is less likely to enter from the upper end of light guiding part 19 and the temperature rise of infrared sensor 16 can be suppressed.

As infrared sensor 16 is arranged at a position between the windings of the heating coil within 50% of the outer diameter of heating coil 13, influence by solar light and ambient light of incandescent light bulb and the like on infrared sensor 16 can be suppressed even when heating relatively small pan 11.

In the embodiment described above, heating coil 13 is divided into inner coil 13*a* and outer coil 13*b*, and light guiding part 19 is arranged in inter-coil 13*c*, that is, between the windings of heating coil 13, but effects similar to the above-described embodiments can be obtained, other than that measurement of the maximum temperature of pan 11 with infrared sensor 16 becomes difficult, by arranging light guiding part 19 on the inner side of the inner periphery of heating coil 13 to contact the inner periphery or at the vicinity of the inner periphery without dividing heating coil 13. In this case as well, measurement can be made at satisfactory sensitivity compared to when measuring the temperature of pan 11 at the upper part of the central portion of heating coil 13.

Furthermore, in the above embodiment, one part (projection 16*a*, projection 15*b*) of light guiding part 19 is integrally molded with heating coil supporting board 15 with the same resin, but heating coil supporting board 15 and light guiding part 19 may be separately assembled, and light guiding part 19 may be attached to and integrated with heating coil supporting board 15.

Furthermore, in the above embodiment, shield part 18 and projection 18*a* are integrally molded with the same metal material, but may be individually molded and assembled to be integrated. Alternatively, light guiding part 19 may be formed only with the nonmetallic material such as resin and the lower end of light guiding part 19 may be inserted to the inside of shield part 18 from a shield part opening (not shown), which is a pass-through hole formed in the upper surface of shield part 18. According to such configuration, the shield part can be formed by bending a metal plate, and thus can have a simple and easy configuration.

The material of shield part 18 may be a non-magnetic high conductivity metal material such as aluminum and copper, in which case the electromagnetic shield can be effectively carried out and self-heating by the induced magnetic field can be suppressed, but may be a magnetic metal material such as iron if inconveniences such as self-heating does not occur, or may be a resin material to provide a function serving as a housing for shielding light if the electromagnetic shield is unnecessary.

INDUSTRIAL APPLICABILITY

Therefore, the present invention is useful as an induction heating cooker etc. using an infrared sensor as significant effects in that the possibility of the pan bottom heating to red heated/deformed is low and safety is ensured can be achieved even when the pan is empty heated regardless of the thickness or the material of the pan.

The invention claimed is:

1. An induction heating cooker comprising:

a top plate where a pan is placed;

a heating coil for induction heating the pan;

a heating coil supporting board for holding the heating coil;

an inverter circuit for supplying a high frequency current to the heating coil;

an infrared sensor, which is arranged under the heating coil and detects an infrared light radiated from the pan;

a light guiding part including an upper projection defining an upper opening formed at an upper end of the heating coil supporting board and facing the top plate and a lower projection defining a lower opening formed at a lower end of the heating coil supporting board, and guiding the infrared light from the pan to the infrared sensor through the upper opening and the lower opening, the light guiding part radially spaced from an axial center of the heating coil;

a shield part for shielding radiation or light from the heating coil to the infrared sensor at a periphery of the infrared sensor, the shield part extending from the lower projection of the light guiding part, the infrared sensor positioned within the shield part and below the lower projection of the light guiding part, the shield part being configured by non-magnetic metal and covering a lower side and the periphery of the infrared sensor; and a control unit for controlling an output of the inverter circuit according to an output from the infrared sensor, wherein the light guiding part includes a nonmetallic material part in which the upper opening is formed above a lower surface of the heating coil.

2. The induction heating cooker according to claim 1, further comprising:

a ferrite, which is arranged under the heating coil and concentrates a magnetic flux under the heating coil on a vicinity of the heating coil, wherein the light guiding part has the lower opening positioned lower than a lower surface of the ferrite.

3. The induction heating cooker according to claim 1, further comprising:

a convex lens at an upper side of the infrared sensor to collect light so as to increase an amount of infrared light entering the infrared sensor from the pan without being reflected in the light guiding part.

4. The induction heating cooker according to claim 3, wherein a wall surface of a passage from the pan to the infrared sensor of the light guiding part is formed by a light absorbing material.

5. The induction heating cooker according to claim 1, wherein the light guiding part includes a non-magnetic metal material part, which is connected to the lower opening, at the lower side of the nonmetallic material part, and the shield part and the non-magnetic metal material part of the light guiding part are integrally formed.

6. The induction heating cooker according to claim 2, further comprising:

a heating coil supporting board for supporting the heating coil and the ferrite, wherein the nonmetallic material part of the light guiding part is arranged at the heating coil supporting board.

7. The induction heating cooker according to claim 6, wherein the nonmetallic material part of the light guiding part is integrally molded with the heating coil supporting board with a same resin.

8. The induction heating cooker according to claim 1, wherein a lower end of the light guiding part is inserted into an interior of the shield part from a shield part opening formed at the shield part.

9. The induction heating cooker according to claim 1, wherein an upper end of the light guiding part is positioned upper than an upper surface of the heating coil.

10. The induction heating cooker according to claim 1, wherein the heating coil comprises an inner heating coil and an outer heating coil;

the light guiding part is arranged between the inner heating coil and the outer heating coil; and the light guiding part is radially inward from a midpoint between the axial center of the heating coil and an outermost edge of the outer heating coil.

11. The induction heating cooker according to claim 1, wherein the light guiding part is arranged at a vicinity of an inner side of an inner periphery of the heating coil.

* * * * *